US008122835B2

(12) United States Patent
Körner

(10) Patent No.: US 8,122,835 B2
(45) Date of Patent: Feb. 28, 2012

(54) UNDERCARRIAGE FOR A RAIL VEHICLE

(75) Inventor: Olaf Körner, Nürnberg (DE)

(73) Assignee: Siemens Aktiengesellschaft, München (DE)

( * ) Notice: Subject to any disclaimer, the term of this patent is extended or adjusted under 35 U.S.C. 154(b) by 252 days.

(21) Appl. No.: 12/531,590

(22) PCT Filed: Mar. 13, 2008

(86) PCT No.: PCT/EP2008/053031

§ 371 (c)(1),
(2), (4) Date: Sep. 16, 2009

(87) PCT Pub. No.: WO2008/113744

PCT Pub. Date: Sep. 25, 2008

(65) Prior Publication Data

US 2010/0116167 A1 May 13, 2010

(30) Foreign Application Priority Data

Mar. 19, 2007 (DE) ..... 10 2007 013 050

(51) Int. Cl.
*B61F 5/00* (2006.01)

(52) U.S. Cl. ..... 105/133; 105/182.1; 105/96; 105/96.1; 105/136; 105/138; 105/199.1

(58) Field of Classification Search ..... 105/165, 105/167, 172, 173, 174, 175.1, 176, 182.1, 105/194, 34.1, 96, 96.1, 199.1, 200
See application file for complete search history.

(56) References Cited

U.S. PATENT DOCUMENTS

| | | | | |
|---|---|---|---|---|
| 3,799,066 | A * | 3/1974 | Jackson | 105/182.1 |
| 4,167,906 | A * | 9/1979 | Steinmann et al. | 105/168 |
| 4,273,055 | A * | 6/1981 | Borgeaud et al. | 105/190.2 |
| 4,787,318 | A * | 11/1988 | Vogel | 105/136 |
| 5,181,473 | A * | 1/1993 | Petit et al. | 105/133 |
| 5,524,550 | A * | 6/1996 | Richter et al. | 105/167 |
| 6,253,686 | B1 * | 7/2001 | Koelsch | 105/182.1 |
| 2010/0307371 | A1 * | 12/2010 | Rodet | 105/133 |
| 2011/0100253 | A1 * | 5/2011 | Koyama et al. | 105/34.1 |

FOREIGN PATENT DOCUMENTS

| | | | |
|---|---|---|---|
| DE | 27 42 850 | A1 | 3/1979 |
| DE | 93 02 772 | U1 | 4/1993 |
| DE | 198 10 697 | A1 | 9/1999 |
| EP | 1 452 766 | A2 | 9/2004 |
| GB | 399 373 | A | 10/1933 |
| WO | WO 01/79048 | A1 | 10/2001 |
| WO | WO 01/79049 | A1 | 10/2001 |

* cited by examiner

*Primary Examiner* — Mark Le

(74) *Attorney, Agent, or Firm* — Henry M. Feiereisen; Ursula B. Day

(57) ABSTRACT

An undercarriage (1) for a rail vehicle has an undercarriage frame (2) comprising two longitudinal supports (3) and at least one transverse support (4) connected thereto. The undercarriage has at least two wheelsets (7) supported in wheelset bearings (6), each wheelset having a wheelset shaft (8) and two wheels (5). The wheelset bearings (6) are connected to the undercarriage frame (2). The undercarriage (1) has at least one drive (9) accommodated in the undercarriage frame (2) for driving one wheelset shaft (8) each. The at least one drive (9) is suspended in a movable fashion on the at least one transverse support (4). According to the invention, the at least one transverse support (4) can be connected in an articulated fashion to a locomotive or railcar body (16) via at least one tension/pressure element (41, 42) disposed in an articulated fashion on a top side (OS) and a bottom side (US) of the transverse support (4).

14 Claims, 7 Drawing Sheets

FIG 4 LSE
Prior Art

UNDERCARRIAGE FOR A RAIL VEHICLE

CROSS-REFERENCES TO RELATED APPLICATIONS

This application is the U.S. National Stage of International Application No. PCT/EP2008/053031, filed Mar. 13, 2008, which designated the United States and has been published as International Publication No. WO 2008/113744 and which claims the priority of German Patent Application, Serial No. 10 2007 013 050.5, filed Mar. 19, 2007, pursuant to 35 U.S.C. 119(a)-(d).

BACKGROUND OF THE INVENTION

The invention relates to an undercarriage for a rail vehicle, which undercarriage has an undercarriage frame having two longitudinal supports and at least one transverse support connected thereto. The undercarriage has at least two wheelsets which are mounted in wheelset bearings and each have a wheelset shaft and two wheels. The wheelset bearings are connected to the undercarriage frame. The undercarriage has at least one drive, accommodated in the undercarriage frame, for driving one wheelset shaft in each case, wherein the at least one drive is suspended in a movable fashion on the at least one transverse support.

The undercarriage is preferably a bogie, in particular a motor bogie. The rail vehicle can be, for example, a locomotive, an urban railway vehicle, an underground railway vehicle or a tram. An undercarriage typically accommodates two drives which each drive one wheelset shaft. A drive typically has a traction motor and a transmission connected thereto. Alternatively, just one driven wheelset may be accommodated in the undercarriage. It is also possible for a plurality of driven wheelsets, for example three or four, to be accommodated. In addition to the driven wheelsets, non-driven wheelsets may also be accommodated in the undercarriage. The wheelsets may be fixedly-mounted-wheel wheelsets or individually-mounted-wheel wheelsets.

The international publication WO 01/079048 A1 describes such an undercarriage for a rail vehicle. In one embodiment, drives are arranged in a co-axial design in the region of the transverse support. In a further embodiment, traction and compression forces are transmitted to the superstructure of the rail vehicle via a tension/compression rod, in the form of a low traction linkage, connected to the drive. The drive is of a non-co-axial design. In a further embodiment, the drives are connected to one another via rods or bars. In each case, two rods which are arranged parallel one on top of the other connect two drives to one another. In this embodiment, the drives are of a co-axial design.

Furthermore, undercarriages with cannon box drives or axial-riding drives are generally known from the prior art.

SUMMARY OF THE INVENTION

An object of the invention is to specify an undercarriage for a rail vehicle, which undercarriage is of a design which is lighter in weight compared to the prior art.

The object of the invention is achieved with an undercarriage having an undercarriage frame including two longitudinal supports and at least one transverse support connected thereto, at least two wheelsets which are mounted in wheelset bearings and each have a wheelset shaft and two wheels, wherein the wheelset bearings are connected to the undercarriage frame, at least one drive, accommodated in the undercarriage frame, for driving one wheelset shaft in each case, wherein the at least one drive is suspended in a movable fashion on the at least one transverse support, wherein the at least one transverse support can be connected in an articulated fashion to a locomotive body or railcar body by means of, in each case, at least one tension/compression element which is connected in an articulated fashion to an upper side and to a lower side of the transverse support.

According to the invention, the at least one transverse support is connected in an articulated fashion to a locomotive body or railcar body by means of, in each case, at least one tension/compression element which is connected in an articulated fashion to an upper side and to a lower side of the at least one transverse support.

As a result, driving forces and braking forces or traction forces and compression forces in the direction of travel of the undercarriage are advantageously applied from the wheel/rail contact into the drive and further via the tension/compression rods directly into the transverse support and to the locomotive body or railcar body while largely avoiding the bogie frame.

The tension/compression rods can be connected to the locomotive body or railcar body on both sides thereof, that is to say there are four tension/compression rods which connect the at least one transverse support to the locomotive body or railcar body. Alternatively, there may also be just two tension/compression rods which connect the at least one transverse support to the locomotive body or railcar body.

The braking forces may not only be caused by the drives but also by a mechanical braking device such as, for example, a disk brake or an electromagnetic rail brake or else by an eddy current brake which operates in a contactless fashion.

The design of the undercarriage is also simplified. In addition, the overall mass of the undercarriage is advantageously reduced. As a result of this, the running behavior of the undercarriage is improved.

In particular, the undercarriage has (just) one transverse support on which two drives are suspended. Alternatively, the undercarriage can also have two or even three transverse supports. One or two drives, which each drive a wheelset, can be suspended on each transverse support. If there are two transverse supports, each transverse support can be connected to the adjacent locomotive body or railcar body by means of two tension/compression rods. It is also possible for the upper tension/compression rod to be connected to both upper sides of the transverse support and for the lower tension/compression rod to be connected to both lower sides of the transverse support. In this case, the tension/compression rods can be connected to the locomotive body or railcar body on just one side or on both sides. Any desired combinations are conceivable for the abovementioned exemplary configuration variants of the undercarriage.

According to one embodiment, the tension/compression elements each have a first end. A bearing block is respectively arranged on the upper side and on the lower side of the transverse support. The first ends of the tension/compression elements form in each case one joint with the respectively bearing block. The bearing block can, for example, be welded, riveted or screwed to the transverse support. Said bearing block can also be an integral component of the transverse support itself.

In particular, according to a further embodiment, the joints are arranged in a cross-sectional plane through the center of the undercarriage.

The "cross-sectional plane" extends, in particular through the (structural) center of the vehicle. At the same time, said "cross-sectional plane" is perpendicular to the plane of the rails, that is to say orthogonal to a plane running through the rotational axes of the wheelset shafts if the wheels of the undercarriage have the same wheel diameter. In addition, the cross-sectional plane extends in parallel and in the center with respect to the rotational axes of the wheelset shafts. Such an arrangement of the abovementioned components simplifies the design of the undercarriage further.

According to another embodiment, the joints are arranged in a longitudinal-sectional plane through the center of the undercarriage. "Longitudinal-sectional plane" denotes a plane extending perpendicularly with respect to the plane of the rails. Said "longitudinal-sectional plane" is therefore at the same time perpendicular to a plane extending through the rotational axes of the wheelset shafts if the wheels of the undercarriage have the same wheel diameter. The intersection line of the cross-sectional plane with the longitudinal-sectional plane is here at the same time a (structural) axis of reflection of the undercarriage. The center of the undercarriage is typically the axis of reflection of the components of the undercarriage.

If the joints are arranged both in the cross-sectional plane and in the longitudinal-sectional plane of the undercarriage, the longitudinal forces from the transverse support are advantageously applied as centrally as possible to the locomotive body or railcar body via the tension/compression rods. This simplifies the design of the undercarriage further.

According to one particularly advantageous embodiment, the joints are spherical bearings or ball bearings. This permits torque-free application of the longitudinal forces, that is to say the traction forces and compression forces, from the transverse support to the locomotive body or railcar body.

The transverse support preferably has a longitudinal-symmetry axis which extends in a cross-sectional plane through the center of the undercarriage. The transverse support is preferably arranged in the geometric center of the undercarriage. Said longitudinal-symmetry axis extends perpendicularly with respect to the plane of the rails and forms at the same time the intersection line of the (structural) longitudinal-sectional plane with the (structural) cross-sectional plane of the undercarriage. When the transverse support is arranged in such a way, the term central transverse support is also used.

The at least one transverse support preferably has a transverse-symmetry axis which extends in a longitudinal-sectional plane through the center of the undercarriage. This simplifies the design of the undercarriage further.

In particular, the longitudinal-symmetry axis and the transverse-symmetry axis of the at least one transverse support extend in a plane which extends through the rotational axes of the wheelset shafts.

According to a further advantageous embodiment, the tension/compression elements have a longitudinal axis. The longitudinal axes extend parallel to one another. In addition to the application of longitudinal forces, this arrangement also advantageously permits torques to be applied from the drives to the locomotive body or railcar body.

According to a further embodiment, the tension/compression elements are arranged in mirror-inverted fashion with respect to a plane extending through the rotational axes of the wheelset shafts. In this case, the resultant force of two tension/compression elements when the longitudinal forces are applied to the locomotive body or railcar body extends precisely in this plane and preferably along the intersection line between the longitudinal-sectional plane and the plane extending through the rotational axes of the wheelset shafts. This permits virtually torque-free application of the torques originating from the drives to the locomotive bodies or railcar bodies. The torques which are applied to the transverse support are immediately applied further to the locomotive body or railcar body via the tension/compression elements. Torque-associated loading of the undercarriage frame therefore occurs only to a small degree.

According to one particular embodiment, the wheelset bearings in the undercarriage frame are each connected to at least one transverse support by means of a wheelset connecting rod. As a result, in addition to application of the longitudinal forces from the wheel contact points to the transverse support via the wheelset bearing and the wheelset connecting rods, transverse forces can also advantageously be applied to the transverse support. The applied forces are applied to the locomotive body or railcar body via the tension/compression elements.

The at least one transverse support is preferably connected laterally to the wheelset connecting rods. The wheelset connecting rods can be connected to the transverse support by means of a comparatively rigid connecting element such as, for example, a rubber/metal element.

According to one preferred embodiment, the two drives accommodated in the undercarriage frame are cannon box drives with one traction motor and one transmission each. The traction motors are connected to a cannon box tube which is rotatably mounted co-axially with respect to the wheelset shaft. The traction motor has a torque support by means of which the respective traction motor is connected in an articulated fashion to the transverse support. As an alternative to the cannon box drives, the drives accommodated in the undercarriage frame can be axial-riding drives with one traction motor and one transmission each. Alternatively, it is possible for just one cannon box drive to be accommodated in the undercarriage. It is also alternatively possible for three or more cannon box drives to be accommodated.

As a result, the driving torques or braking torques of the cannon box drive can advantageously be supported on the transverse support.

In this embodiment, the traction motor is seated, as it were, on the wheelset or on the wheelset shaft. Between the wheelset shaft and the cannon box tube, cannon boxes are arranged which, to a certain degree, also permit axial relative movement between the cannon box tube and the wheelset shaft. The word "axial" denotes directions parallel to the rotational axis of the wheelset shaft. The transmission has gear wheels which mesh with one another. The transmission usually has a large wheel and a small wheel, which transmission is driven by the traction motor. The large wheel is connected in a rotationally fixed fashion to the wheelset shaft.

Furthermore, the torque supports can be connected in an articulated fashion to the lower side of the transverse support. Alternatively, said torque supports can be connected in an articulated fashion to the transverse support via one pendulum each. The latter embodiment permits a more elastic connection of the drives to the transverse support. Only parts of the drive masses are therefore suspended primarily on the transverse support in the vertical direction. They therefore do not form part of the unsprung part of the wheelset masses.

According to a further embodiment, the transverse support has two side regions which each lie opposite a traction motor. In each case one bracket is arranged in the side region of the transverse support. The upper end of the pendulum is accommodated in an articulated fashion in the bracket. The lower end of the pendulum is connected in an articulated fashion to the torque support of the respective traction motor. The suspension of the traction motor and of the drive which oscillate to a certain extent can compensate better compensation movements of the traction motors during travel.

According to a further advantageous embodiment, in each case a bearing block or bracket for the articulated connection of the tension/compression elements is arranged on the upper side (OS) and lower side (US) of the transverse support. In addition, in each case a traction force connecting rod is arranged in an articulated fashion between the lower bearing block and the torque supports.

By means of the traction force connecting rods, the traction forces and braking forces can be applied more directly to the transverse support via the cannon box drive. In particular, the traction force connecting rods have a longitudinal axis which each extend in a longitudinal-sectional plane through the center of the undercarriage.

If, according to a further embodiment, the traction force connecting rods are arranged parallel to a plane extending through the rotational axes of the wheelset shafts, the traction forces and braking forces can be applied to the transverse support in a plane parallel to the tension/compression elements.

According to a further embodiment, the traction force connecting rods are arranged between the lower side of the transverse support and the lower tension/compression element. This arrangement permits the traction forces and braking forces which are passed on via the torque supports and which are relatively small in absolute terms to be applied to the transverse support as close as possible to the plane extending through the rotational axes of the wheelset shafts.

The wheelset connecting rods are preferably arranged parallel to the traction force connecting rods. As a result of the apportionment of forces it is possible for the wheelset connecting rods to be made less rigid with respect to the connection to the transverse support compared to the solution without traction force connecting rods. This is more favorable in terms of technical running properties when the undercarriage travels through a bend.

When the traction force connecting rods are arranged centrally, that is to say the traction force connecting rods are arranged in the plane of the wheelset shafts and the longitudinal-sectional plane of the undercarriage, comparatively small bending torques about the vertical axis of the transverse support result owing to the traction forces and braking forces compared to the application of these forces via the wheelset connecting rods.

According to one particularly advantageous embodiment, in each case two cannon boxes are arranged between the wheelset shaft and the cannon box tube. The cannon boxes form in each case an integrated structural unit with the wheelset bearings. This reduces the expenditure on components for such an undercarriage.

As an alternative to the cannon box drives, the two drives accommodated in the undercarriage frame can be axial-riding drives with one traction motor and one transmission each. Alternatively, there may be one, three or more axial-riding drives in the undercarriage.

In this embodiment, the traction motor is connected, in particular, in a transversely elastic fashion to the transverse support. The traction motors can be attached to the transverse support by means of a rubber element, for example. As a result of the connection to the transverse support, the traction motor is part of what are referred to as the sprung masses. The transmission has gear wheels which mesh with one another. The transmission usually has a large wheel and a small wheel or alternatively a large wheel, an intermediate wheel and a small wheel. The large wheel is connected in a rotationally fixed fashion to the wheelset shaft. In order to transmit torque, the small wheel and a motor shaft of the traction motor may be connected via a toothed coupling. The toothed coupling permits both axial and radial relative movements of the motor shaft with respect to a transmission input shaft of the small wheel. The word "radial" denotes directions toward the rotational axis of the motor shaft and away from said rotational axis. The toothed coupling decouples the sprung mass of the traction motor from the unsprung mass of the axial-riding transmission.

In one particular embodiment, the one transmission has an even number of transmission stages, and the other transmission has an uneven number of transmission stages with the same transmission ratio. The first transmission is preferably a single-stage transmission, and the second transmission a two-stage transmission. Alternatively, the first transmission can, for example, be designed with two stages and the second transmission with three stages.

As a result, the reaction torques of the traction motors which act on the transverse support are compensated.

The transmissions of the axial-riding drives are preferably connected to a cannon box tube which is rotatably mounted co-axially with respect to the wheelset shaft. This permits a small degree of axial relative movement of the cannon box tube with respect to the wheelset shaft.

According to a further embodiment, the tension/compression elements and/or the traction force connecting rods are rigid tension/compression rods.

They can have a hinge joint or ball-socket joint at the respective end. They can also have eyelets which correspond to respectively corresponding bearing bolts.

According to a further embodiment, the two longitudinal supports of the bogie frame are connected in a moveable fashion to the at least one transverse support such as, for example, via cylinder springs or rubber elements. This improves the running comfort of the undercarriage.

BRIEF DESCRIPTION OF THE DRAWING

The invention and advantageous embodiments of the invention will be described in more detail below with reference to the following figures, in which.

DETAILED DESCRIPTION OF PREFERRED EMBODIMENTS

Figure 1:
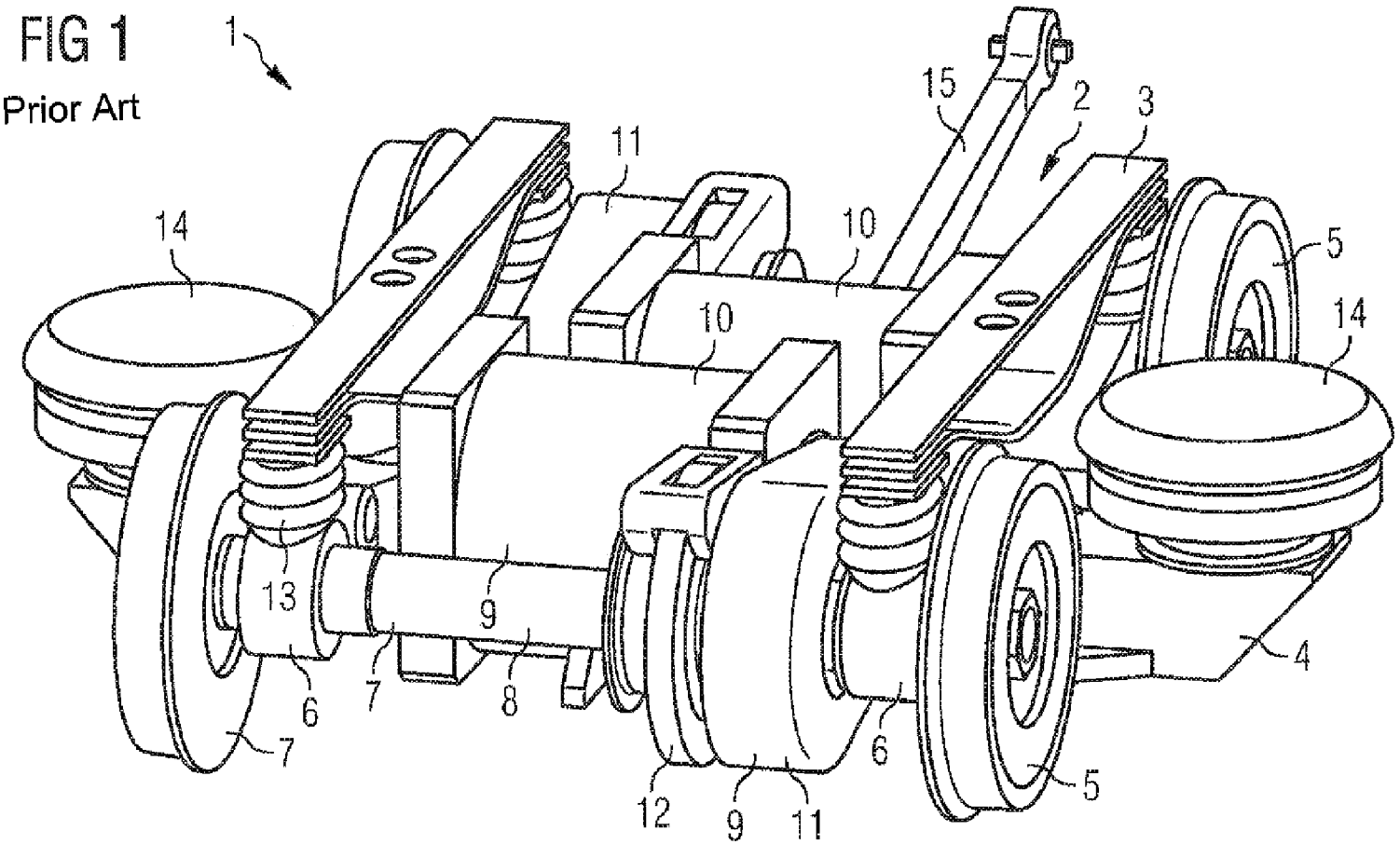
FIG 1 Prior Art
FIG. 1 shows by way of example an undercarriage having two drives according to the prior art.

FIG. 1 shows by way of example an undercarriage 1 having two drives 9 according to the prior art.

Figure 2:
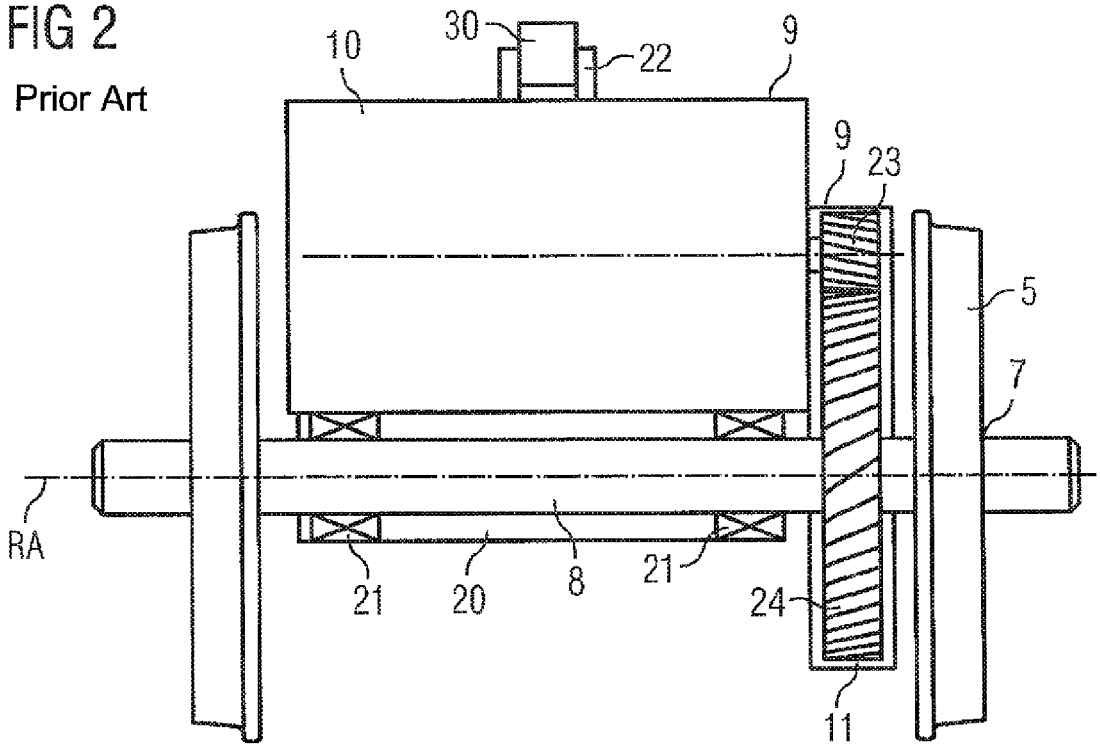
FIG 2 Prior Art
FIG. 2 shows by way of example a wheelset having a cannon box drive in a plan view according to the prior art.

The undercarriage 1 which is shown comprises an undercarriage frame 2, composed of two longitudinal supports 3 and a transverse support 4 connected thereto. In the example in FIG. 1, the undercarriage 1 has two wheelsets 7 which each have a wheelset shaft 8 and two wheels 5. The wheelsets 7 are mounted in wheelset bearings 6 which, in the example in FIG. 2, are connected to the transverse support 4. Two non-co-axial drives 9 are accommodated in the undercarriage frame 2. In this case, the rotational axis of the traction motor 10 lies outside the rotational axis of the wheelset shaft 8. Co-axial drives 9 are, for example, direct drives. For the application of longitudinal forces, that is to say of traction forces and compression forces, in particular of driving forces and braking forces of the undercarriage, the drive 9 which is located further toward the rear in the plane of the diagram is connected to a locomotive body or railcar body (not shown in more detail) via a tension/compression rod 15. The two drives 9 can be connected to one another in an articulated fashion by means of a rod (not shown in FIG. 1).

Furthermore, the two wheelsets 7 each have a brake device 12. Primary springs are denoted by the reference symbol 13. Said primary springs are arranged between the undercarriage frame 2 and the wheelset bearings 6 for the purpose of damping. The longitudinal supports 3 can be connected in an articulated fashion to the transverse support 4. The undercarriage 1 can be connected, by means of large secondary springs 14 which are embodied as air springs, to a base plate of the rail vehicle, which is located above said secondary springs 14 and is not shown in more detail.

FIG. 2 shows by way of example a wheelset 7 with a cannon box drive 9 in a plan view according to the prior art.

As is shown by FIG. 2, the traction motor 10 is, as it were, seated on the wheelset shaft 8. A cannon box tube 20, which is co-axial with respect to the wheelset shaft 8, can be seen between the traction motor 10 and the wheelset shaft 8. The reference number 21 denotes two associated cannon boxes. The traction motor 10 drives, via a small wheel 23, a large wheel 24 which is fixedly connected to the wheelset shaft 8. The traction motor 10 also has a traction motor suspension system 22 by means of which the traction motor 10 can be connected in an articulated fashion to a transverse support 4.

Figure 3:
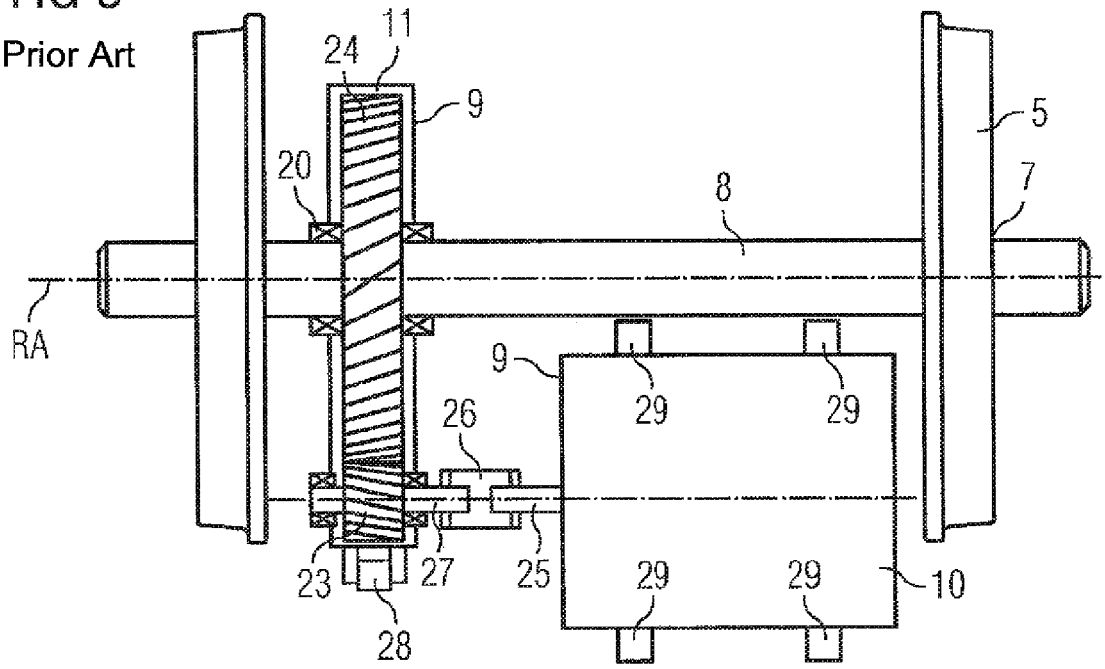
FIG 3 Prior Art
FIG. 3 shows by way of example a wheelset having an axial-riding drive in a plan view according to the prior art.

FIG. 3 shows by way of example a wheelset 7 with an axial-riding drive 9 in a plan view according to the prior art.

In the example in FIG. 3, the traction motor 10 is attached to a transverse support 4 (not illustrated) via traction motor suspension systems 29. The traction motor 10 drives, via a motor shaft 25 and via a subsequent toothed coupling 26, a transmission input shaft 27 which is connected to the small wheel 23. The small wheel 23 drives a large wheel 24 which is fixedly connected in a rotationally fixed fashion to the wheelset shaft 8. The housing (not described in more detail) of the drive 11 is connected to a cannon box tube 20 which is, for example, shorter compared to the cannon box tube 20 in FIG. 2.

Figure 4:
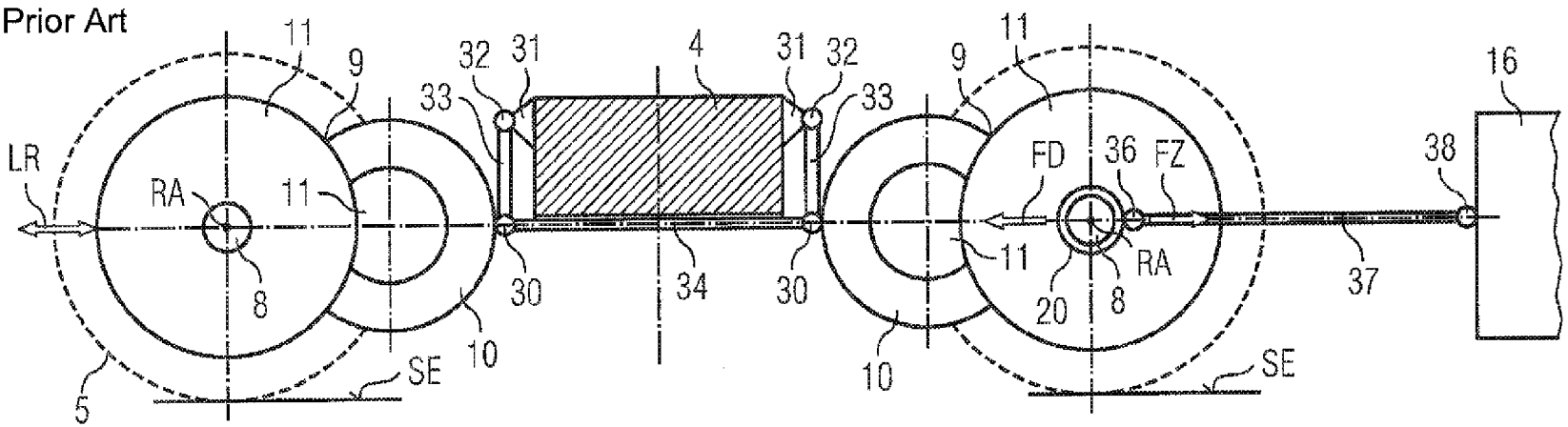
FIG. 4 shows by way of example a longitudinal section through an undercarriage having two cannon box drives which are connected in an oscillating fashion to a transverse support, in a basic illustration according to the prior art.

FIG. 4 shows by way of example a longitudinal section through an undercarriage 1 with two cannon box drives 9 which are connected in an oscillating fashion to a transverse support 4, in a basic illustration according to the prior art. The two traction motors 10 are connected to a cannon box tube 20 which is rotatably mounted co-axially in relation to the respective wheelset shaft 8. Alternatively, just one driven wheelset 7 may be accommodated in the undercarriage 1. It is also possible for a plurality of driven wheelsets 7, for example three or four, to be accommodated. In addition to the driven wheelsets 7, non-driven wheelsets 7 can also be arranged in the undercarriage 1. The wheelsets 7 can be fixedly-mounted-wheel wheelsets or individually-mounted-wheel wheelsets.

In the example in FIG. 4, the longitudinal section extends through the geometric center of the undercarriage 1. The plane of the diagram according to FIG. 4 therefore corresponds to the longitudinal-sectional plane LSE. The longitudinal-sectional plane LSE extends perpendicular to a plane of the rails SE. An axis extending perpendicularly through this center is at the same time the axis of reflection of the undercarriage 1. The word "perpendicular" denotes a parallel orientation to the surface normal of the plane of the rails SE on which the undercarriage 1 shown is located.

Figure 5:
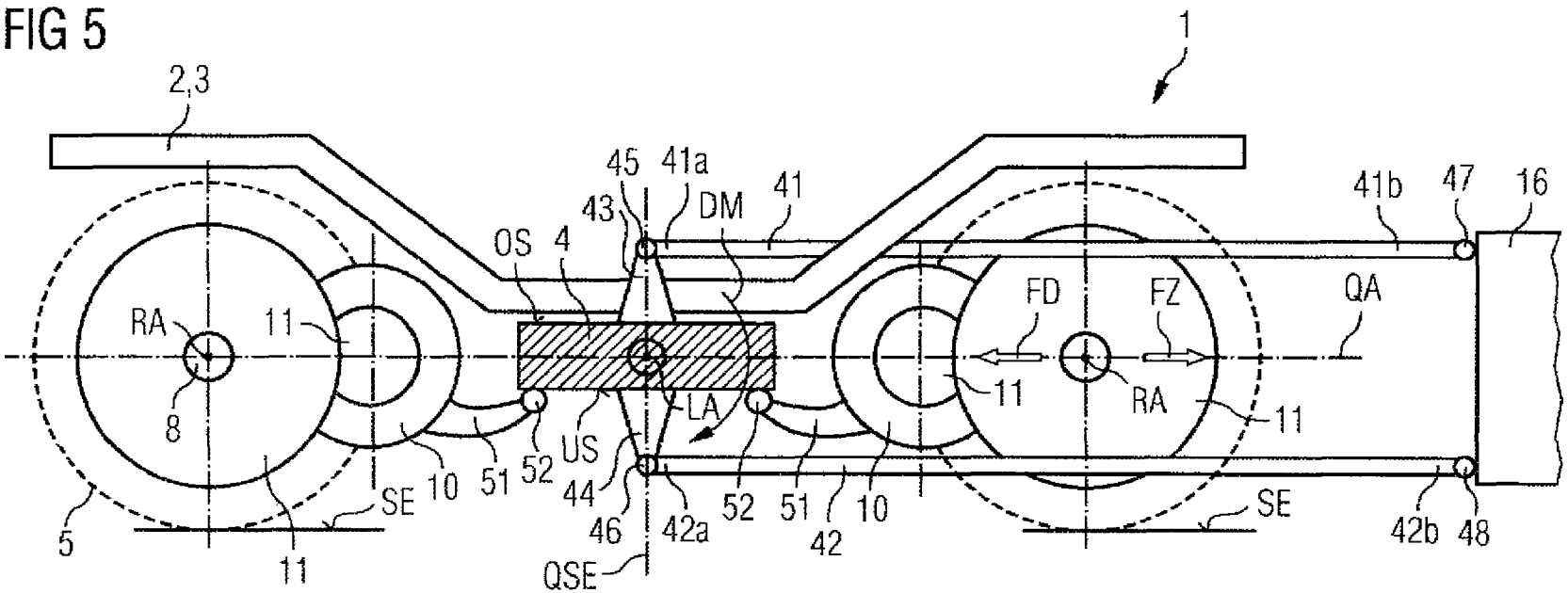
FIG. 5 shows by way of example a longitudinal section through an inventive undercarriage having a transverse support which is arranged centrally in the undercarriage frame and is connected to a locomotive body or railcar body via two tension/compression elements, in a basic illustration.

FIG. 5 shows by way of example a longitudinal section through an inventive undercarriage 1 with a transverse support 4 which is arranged centrally in the undercarriage frame 2 and is connected to a locomotive body or railcar body 16 via two tension/compression elements 41, 42 in a basic illustration.

According to the invention the transverse support 4 can be connected in an articulated fashion to the locomotive body or railcar body 16 by means of, in each case, at least one tension/compression element 41, 42 which is connected in an articulated fashion to an upper side OS and to a lower side US of the transverse support 4. The illustrated tension/compression elements 41, 42 are preferably rigid tension/compression rods. As a result, by means of the arrangement according to the invention, torques DM and traction forces and compression forces FZ, FD which are applied to the transverse support 4 can be applied directly to the locomotive body or railcar body 16 while avoiding the bogie frame.

Furthermore, the reference symbol LA denotes a longitudinal-symmetry axis LA, and QA denotes a transverse-symmetry axis of the transverse support 4. The longitudinal-symmetry axis LA extends in a cross-sectional plane QSE through the center of the undercarriage 1. Furthermore the transverse support 4 is arranged in the undercarriage 1 in such a way that the transverse-symmetry axis QA extends in a longitudinal-sectional plane LSE through the center of the undercarriage 1. In order to pass on with as little torque as possible the traction forces FZ and compression forces FD which are applied from the wheelset contact points, the longitudinal-symmetry axis LA and the transverse-symmetry axis QA of the transverse support 4 also extend in a plane extending through the rotational axes RA of the wheelset shafts 8. Perpendicular sections through the transverse support 4 along the longitudinal-symmetry axis LA and the transverse-symmetry axis QA have at least predominantly a rectangular cross section.

The tension/compression elements 41, 42 which are shown in FIG. 5 each have a first end 41*a*, 42*a*. Second ends 41*b*, 42*b* form in each case a joint 47, 48 with a locomotive-side or railcar-body-side bearing (not illustrated in more detail). Furthermore, in each case a bearing block or a bracket 43, 44 is arranged on the upper side OS and on the lower side US of the transverse support 4, with the first ends 41*a*, 42*a* of the tension/compression elements 41, 42 forming in each case one joint 45, 46 with the respective bearing block 43, 44. The previously described joints 45 to 48 are preferably spherical bearings or ball-and-socket joints.

In the example in FIG. 5, the joints 45, 46 are arranged both in a cross-sectional plane QSE and in a longitudinal-sectional plane LSE through the center of the undercarriage 1. The tension/compression elements 41, 42 which are connected in an articulated fashion thereto extend parallel to one another and also in mirror-inverted fashion with respect to the plane extending through the rotational axes RA of the wheelset planes 8.

Two drives 9 with one traction motor 10 and one transmission 11 each are accommodated in the undercarriage frame 2.

The drives 9 are cannon box drives 9 whose traction motors 10 are connected to a cannon box tube 20 which is rotatably mounted co-axially with respect to the wheelset shaft 8. Each traction motor 10 has, for applying the torque originating from it or from the drive 9, a torque support 51 which is connected in an articulated fashion to the transverse support 4. Braking torques, which originate, for example, from a mechanical brake device arranged in the wheelset 7, can also be applied to the transverse support 4 via the torque support 51. The torque supports 51 which are shown are connected in an articulated fashion to the lower side US of the transverse support 4.

Alternatively, axial-riding drives 9 with one traction motor and one transmission 11 each can be accommodated in the undercarriage frame 2, with the traction motors 10 then in particular being connected in a transversely elastic fashion to the transverse support 4. In this drive variant it is particularly advantageous if the one transmission has an even number of transmission stages, in particular has two stages, and the other transmission has an uneven number of transmission stages, in particular has a single stage, with the same transmission ratio. As a result, the engine torques originating from the two traction motors 10 which are mounted on the transverse support 4 largely compensate one another. In order to apply the torques originating from the transmissions 11 to the transverse support 4, a torque support, which is itself connected in an articulated fashion to the transverse support 4, is mounted on each axial-riding transmission 11.

Figure 6:
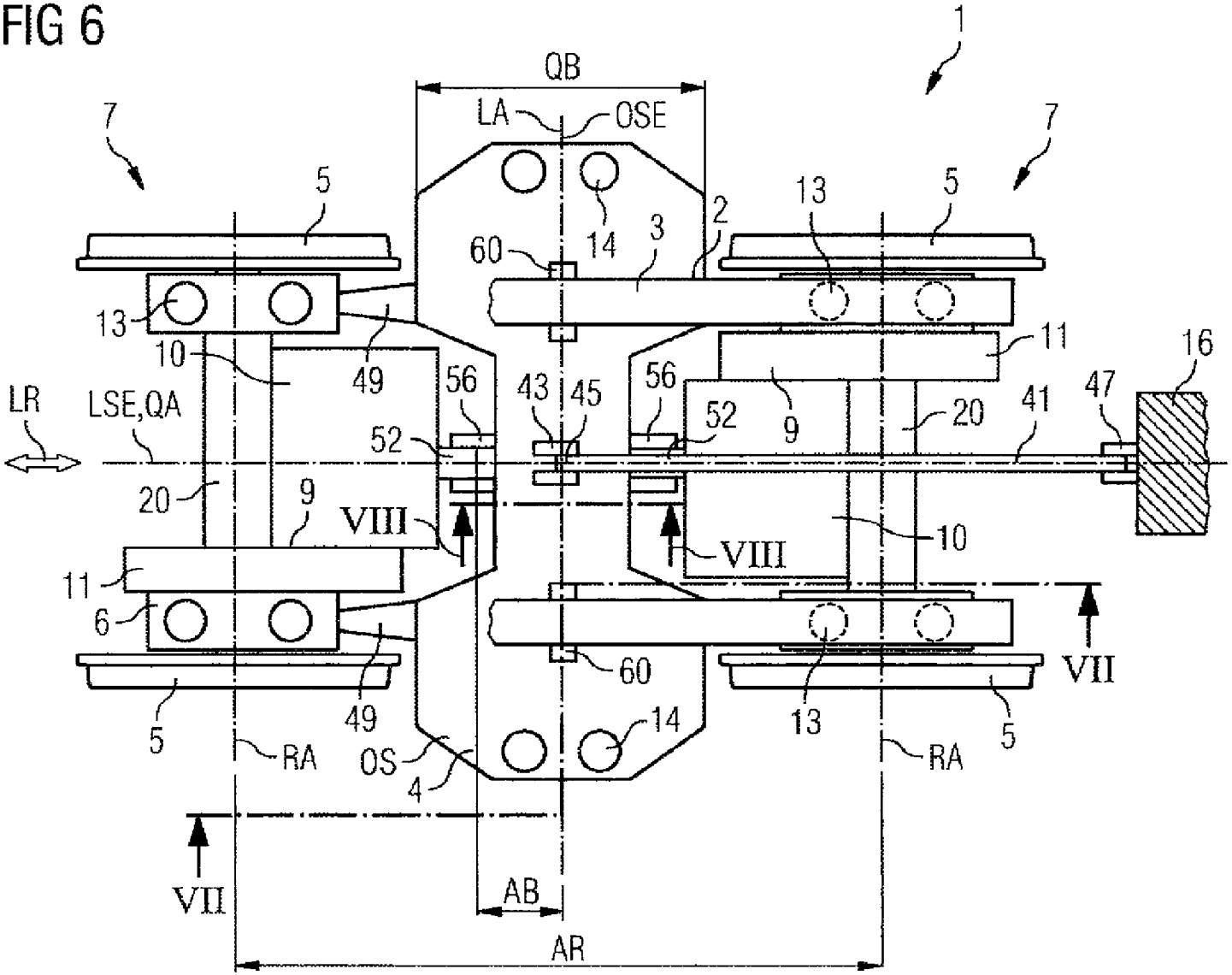
FIG. 6 shows by way of example an undercarriage according to the invention in a structural illustration and in a plan view.

FIG. 6 shows by way of example an undercarriage 1 according to the invention in a structural illustration and in a plan view.

The central transverse support 4 which is shown has a longitudinal-symmetry axis LA and a transverse-symmetry axis QA which are arranged in the cross-sectional plane QSE and in the longitudinal-sectional plane LSE through the (geometric) center of the undercarriage 1. The transverse support 4 is connected in a movable fashion to two longitudinal supports 3 of the undercarriage frame 2 via two guide elements 60. In addition, secondary springs 14 are arranged on the upper side OS of the transverse support 4. Said secondary springs 14 serve to provide suspension to the locomotive body or railcar body 16 (not illustrated) which is "located above them".

In the projected geometric center of the undercarriage there is, on the upper side OS of the transverse support 4, a bearing block 43 to which the upper tension/compression element 41 is connected in an articulated fashion. The other end of the upper tension/compression element 41 is also connected in an articulated fashion to a locomotive body or railcar body 16 (illustrated only in a rudimentary fashion). The lower tension/compression element 42 which is arranged horizontally parallel to the upper tension/compression element 41 is concealed in this illustration by the upper tension/compression element 41 and therefore is not visible. In the structural configuration of the undercarriage 1 which is shown, the tension/compression elements 41, 42 are embodied as tension/compression rods.

Two cannon box drives 9 with one traction motor 10 and one transmission 11 each are accommodated in the undercarriage 1. The traction motors 10 are, on the one hand, connected fixedly to a cannon box tube 20, with the cannon box tube 20 being embodied co-axially with respect to the wheelset shaft 8. In each case two cannon boxes 21 are arranged between the wheelset shaft 8 and the cannon box tube 20, and they each form an integral structural unit with the wheelset bearings 6. On the other hand, the two traction motors 10 are connected in an articulated fashion to the side region of the transverse support 4 via one torque support 51 each in order to apply the traction-motor-side or drive-side torques. The torque supports 51 are also connected in an articulated fashion to the transverse support 4 via one pendulum 55 each, which pendulums 55 are, however, not visible in the present illustration. The torque supports 51 are illustrated in detail in the following FIG. 7 and FIG. 8. Furthermore, the wheelsets 7 are connected to the transverse support 4 via wheelset connecting rods 49. The wheelset bearings 6 can, as shown in FIG. 6, be damped in relation to the respective wheelset connecting rod 49 using, for example, primary springs 13 which are embodied as cylinder springs.

In the example in FIG. 6, the transverse support 4 has a maximum width QB. In the projected illustration of the undercarriage 1, the transverse support 4 is located between the wheelsets 7, viewed in the longitudinal extent LR of the undercarriage 1. AR denotes the distance of the rotational axes RA of the wheelset shafts 8 from one another, and AB denotes the distance of the longitudinal-symmetry axis LA of the transverse support 4 from the bearing axis of the joint 52 in the longitudinal extent LR of the undercarriage 1. The ratio of the distance AB to the maximum width QB of the transverse support 4 is less than ½. In particular, the ratio has a value in a range from ¼ to ⅓, so that virtually torque-free application of the traction-motor-side or drive-side torques to the transverse support 4 can take place. Here, application of the torques as closely as possible to the longitudinal-symmetry axis LA of the transverse support 4 is desirable.

Furthermore, in order to improve the running properties of the undercarriage 1 which is shown in the example in FIG. 6, the wheelset bearings 6 in the undercarriage frame 2 are each connected to the transverse support 4, in particular connected laterally to the transverse support 4, by means of a wheelset connecting rod 49.

Figure 7:
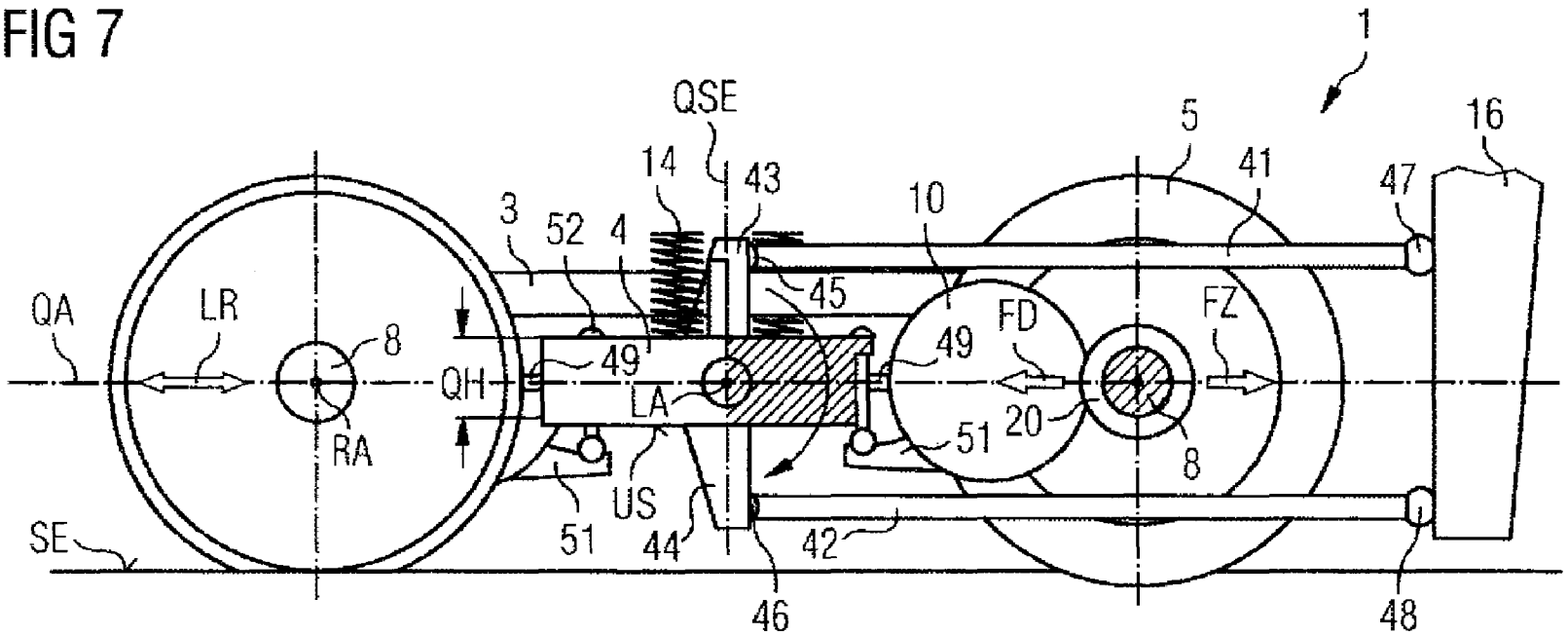
FIG. 7 shows a section through the undercarriage according to FIG. 6 along the sectional line VII-VII given in FIG. 6.

FIG. 7 shows an illustration of a section through the undercarriage 1 according to FIG. 6 along the sectional line VII-VII plotted in FIG. 6.

The two tension/compression rods 41, 42 which are arranged one on top of the other and are arranged parallel to the plane of the rails SE can be seen in the right-hand part of FIG. 7. The reference symbol FZ denotes a traction force which acts on the wheelset shaft 8 and is brought about by the drives 9. The reference symbol FD denotes a compression force which acts on the wheelset shaft 8, in the opposite direction to the traction force FZ. The drive torque which acts on the respective wheelset shaft 8 is denoted by the reference symbol DM. The traction force FZ and compression force FD are, in particular driving forces or braking forces of the drives 9 depending on the direction of travel of the undercarriage. As is shown further in FIG. 7, the torque DM and the longitudinal forces FZ, FD can be applied virtually completely to the locomotive body or railcar body 16 via the two tension/compression rods 41, 42.

In this illustration, the articulated connection of the traction motors 10 via, in each case, one torque support 51 and via, in each case, one pendulum 55 can be seen clearly in the side region of the transverse support 4.

Figure 8:
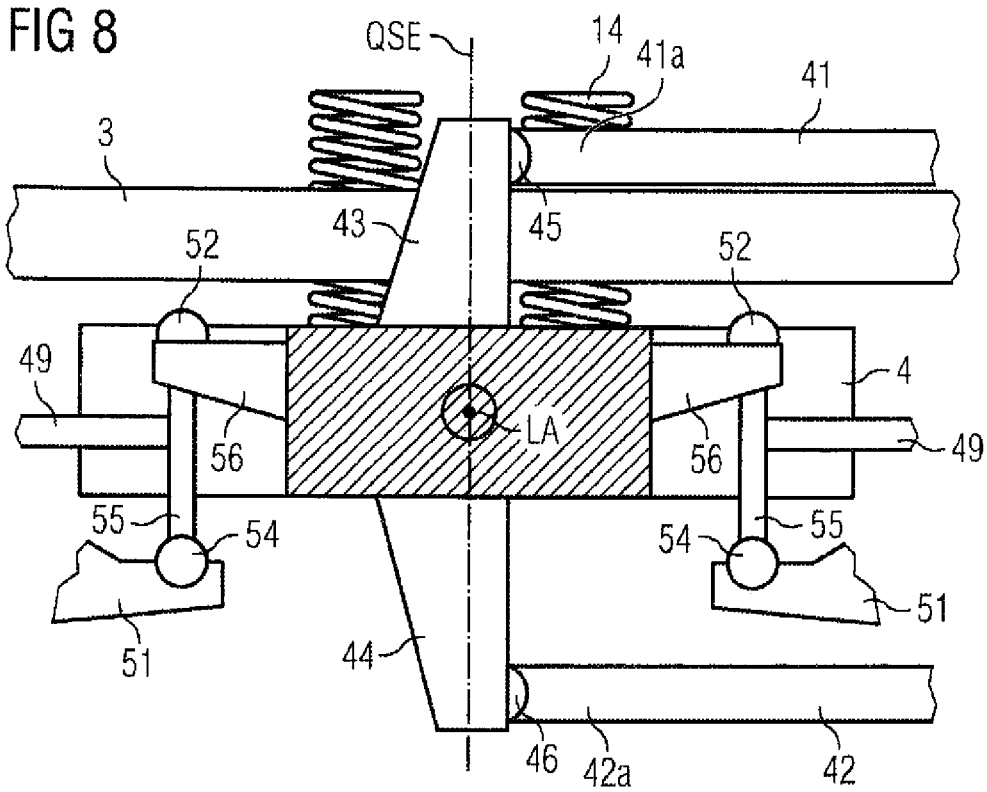
FIG. 8 shows a section through the transverse support along the sectional line VIII-VIII given in FIG. 6, in an enlarged illustration.

FIG. 8 shows an illustration of a section through the transverse support 4 along the sectional line VIII-VIII plotted in FIG. 6, in an enlarged illustration.

In this illustration it is apparent that in each case one bracket 56 is arranged in the side region of the transverse support 4. The upper end of the pendulum 55 is accommodated in an articulated fashion in the bracket 56, while the lower end of the pendulum 55 is connected in an articulated fashion to the torque support 51 of the respective traction motor 10. The oscillating connection permits, to a certain degree, vehicle movement dynamics compensation of transverse movements of the traction motor 10. As a result, only parts of the drive masses are suspended in a primary fashion in the vertical direction on the transverse support 4. They are therefore not included in the unsprung part of the wheelset masses.

Furthermore, FIG. 8 shows the connection of the wheelset connecting rods 49 in the lateral region of the transverse support 4. The wheelset connecting rods 49 can be connected to the transverse support 4 by means of a comparatively rigid connecting element such as, for example, a rubber/metal element.

Figure 9:
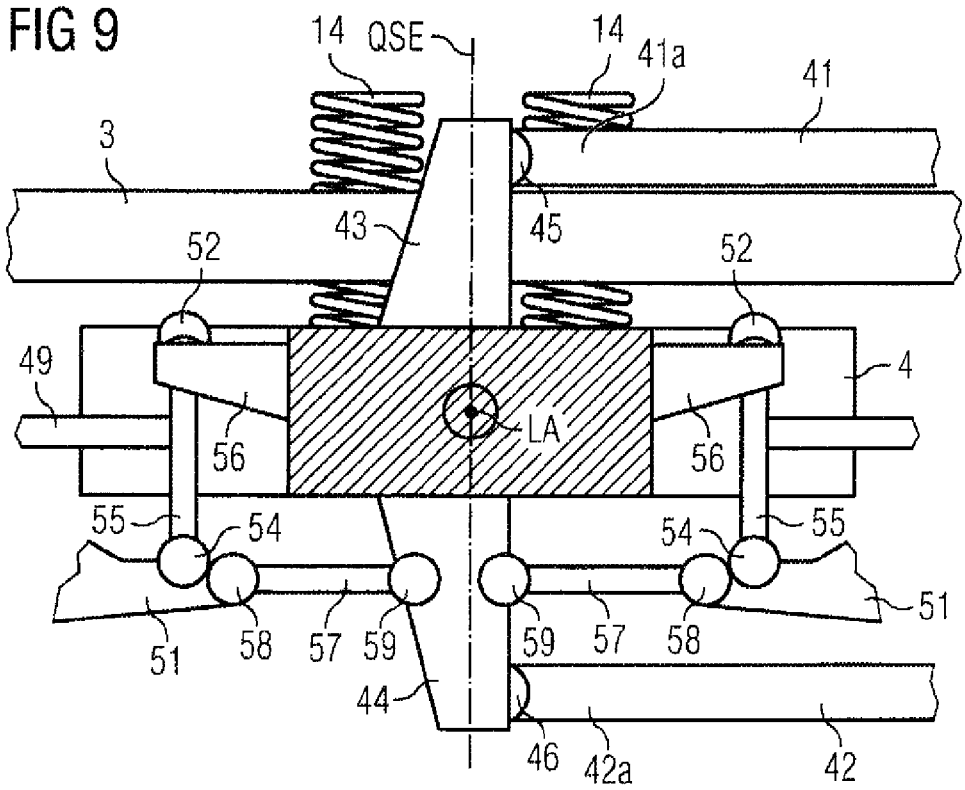
FIG. 9 shows a section through the transverse support in an enlarged illustration corresponding to an alternative embodiment of the undercarriage.

FIG. 9 shows an illustration of a section through the transverse support 4 corresponding to an alternative embodiment of the undercarriage, in an enlarged illustration.

As is shown by FIG. 9, in each case a bearing block 43, 44 for the articulated connection of the tension/compression elements 41, 42 is arranged on the upper side OS and lower side US of the transverse support 4. In addition, in each case a traction force connecting rod 57 is arranged in an articulated fashion between the lower bearing block 44 and the torque supports 51. The traction force connecting rods 57 have a longitudinal axis which each extend in a longitudinal-sectional plane through the center of the undercarriage 1. Said traction force connecting rods 57 are also arranged parallel to a plane extending through the rotational axes of the wheelset shafts and between the lower side US of the transverse support 4 and the lower tension/compression element 42 or the lower tension/compression rod 42. With such an arrangement of the traction force connecting rods 57, comparatively low bending torques result owing to the traction forces and braking forces about the vertical axis of the transverse support 4 compared to the application of these forces via the wheelset connecting rods 49.

As is shown further by FIG. 9, each end of the two traction force connecting rods 57 which are shown has a joint 58, 59. The joints 58, 59 may be, for example, a spherical bearing, a ball bearing or else a rubber/metal element.

The wheelset connecting rods 49 are preferably arranged parallel to the traction force connecting rods 57. As a result of the apportionment of forces, the wheelset connecting rods 49 can be made less rigid with respect to the connection to the transverse support compared to the solution without traction force connecting rods 57. This is more favorable in terms of technical running properties when the undercarriage 1 travels through a bend.

What is claimed is:

1. An undercarriage for a rail vehicle, comprising:

an undercarriage frame having two longitudinal supports and a transverse support which is connected to the longitudinal supports;

two wheelsets mounted in wheelset bearings connected to the undercarriage frame, each wheelset having a wheelset shaft and two wheels;

two drives, accommodated in the undercarriage frame, for driving the wheelset shafts of the wheelsets, each said drive being movably suspended on the transverse support;

first and second tension/compression elements;

a first bearing block arranged on an upper side of the transverse support to provide an articulated connection of the first tension/compression element to a locomotive body or railcar body;

a second bearing block arranged on a lower side of the transverse support to provide an articulated connection of the second tension/compression element to the locomotive body or railcar body;

two torque supports for providing an articulated connection between the drives or a component thereof with the transverse support; and traction force connecting rods connected in an articulated fashion between the second bearing block on the lower side of the transverse support and the torque supports.

2. The undercarriage of claim 1, wherein each said drive is constructed in the form of a cannon box drive with a traction motor and a transmission, said traction motor being connected to a cannon box tube which is rotatably mounted co-axially with respect to the wheelset shaft, said torque supports hingedly connecting the traction motors to the transverse support.

3. The undercarriage of claim 1, wherein each said drive is constructed in the form of an axial-riding drive with a traction motor and a transmission, wherein the traction motor of one of the drives and the traction motor of the other one of the drives are mounted together on the transverse support, said torque supports being respectively mounted on the transmissions of the drives and connected in an articulated fashion to the transverse support.

4. The undercarriage of claim 1, wherein the torque supports are connected in an articulated fashion to the lower side of the transverse support.

5. The undercarriage of claim 1, wherein each of the torque supports is connected in an articulated fashion to the transverse support via a pendulum.

6. The undercarriage of claim 2, wherein each of the torque supports is connected in an articulated fashion to the transverse support via a pendulum, said transverse support having two side regions disposed in opposite relationship to the traction motors of the cannon box drives, and further comprising brackets arranged in the side regions of the transverse support, wherein the pendulums have upper ends received in an articulated fashion in the brackets, and lower ends connected in an articulated fashion to the torque supports of the traction motors of the cannon box drives.

7. The undercarriage of claim 6, wherein the traction force connecting rods have a longitudinal axis extending in a longitudinal-sectional plane through a center of the undercarriage.

8. The undercarriage of claim 6, wherein the traction force connecting rods are arranged in parallel relationship to a plane extending through rotational axes of the wheelset shafts.

9. The undercarriage of claim 6, further comprising two cannon boxes arranged between each of the wheelset shafts and the cannon box tubes, said cannon boxes forming an integrated structural unit with the wheelset bearings.

10. The undercarriage of claim 3, wherein the transmission of one of the axial-riding drives has an even number of transmission stages, and the transmission of the other one of the axial-riding drives has an uneven number of transmission stages with a same transmission ratio.

11. The undercarriage of claim 10, further comprising a bearing tube to connect the transmissions, said bearing tube being rotatably mounted co-axially with respect to the wheelset shaft.

12. The undercarriage of claim 1, wherein the traction force connecting rods and the first and second tension/compression elements are constructed in the form of rigid tension/compression rods.

13. The undercarriage of claim 1, wherein the two longitudinal supports of the undercarriage frame are movably connected to the transverse support.

14. The undercarriage of claim 1, wherein the wheelset bearings in the undercarriage frame are each connected to the transverse support by a wheelset connecting rod.

* * * * *